United States Patent [19]

Wallendal

[11] Patent Number: 4,856,779

[45] Date of Patent: Aug. 15, 1989

[54] GROUND ANCHOR FOR HOME PLATE AND PITCHER'S PLATE AND METHOD OF INSTALLATION

[76] Inventor: Craig D. Wallendal, Rte. 3, Markesan, Wis. 53946

[21] Appl. No.: 155,472

[22] Filed: Feb. 12, 1988

[51] Int. Cl.[4] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 171,038 | 12/1875 | O'Neill | 273/25 |
| 2,624,580 | 1/1953 | Corbelt | 273/25 |
| 4,744,561 | 5/1988 | Hall | 273/25 |

*Primary Examiner*—Edward M. Coven
*Assistant Examiner*—T. Brown
*Attorney, Agent, or Firm*—Fleit, Jacobson, Cohn, Price, Holman & Stern

[57] ABSTRACT

A ground anchor is provided equipped with horizontally spaced apart upstanding tubular members having open upper ends. The ground anchor may be buried in the ground at a depth with the upper ends of the tubular members terminating in a horizontal plane coinciding with the ground upper surface and the ground anchor may thereafter be used to anchor a ground level attachment such as a home plate or pitcher's plate equipped with depending vertical ground spikes stationary relative to the ground by downwardly telescoping the ground spikes of the attachments into the upper ends of the tubular members to a level with a horizontal undersurface of the attachment abutted against the upper ends of the tubular members.

6 Claims, 2 Drawing Sheets

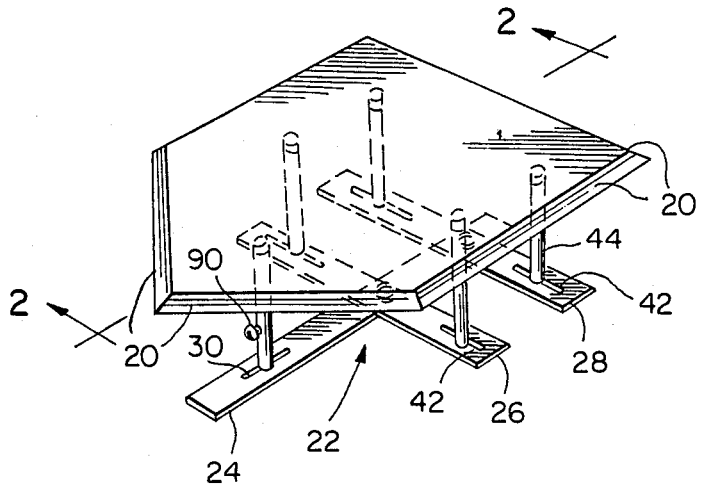
FIG. 1
FIG. 2
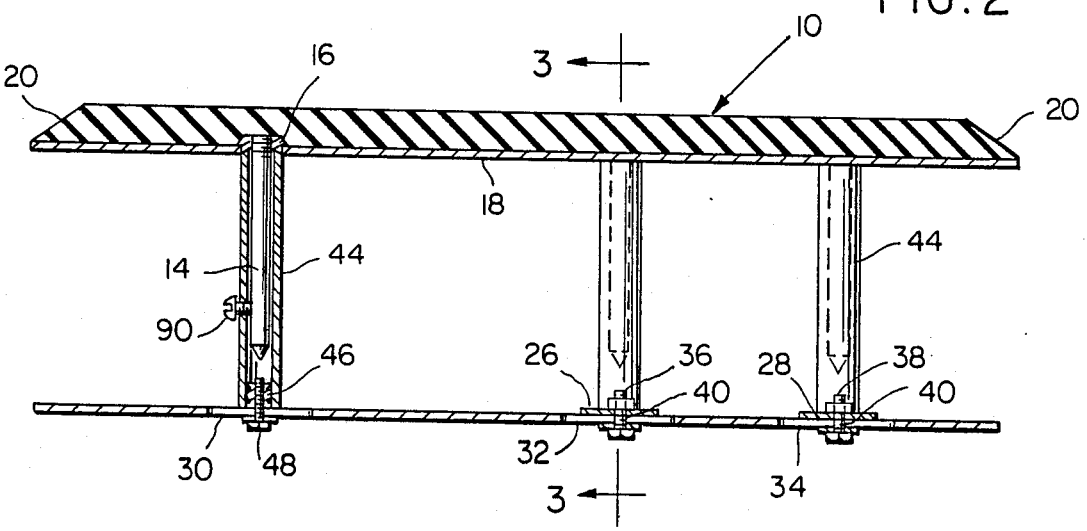
FIG. 3
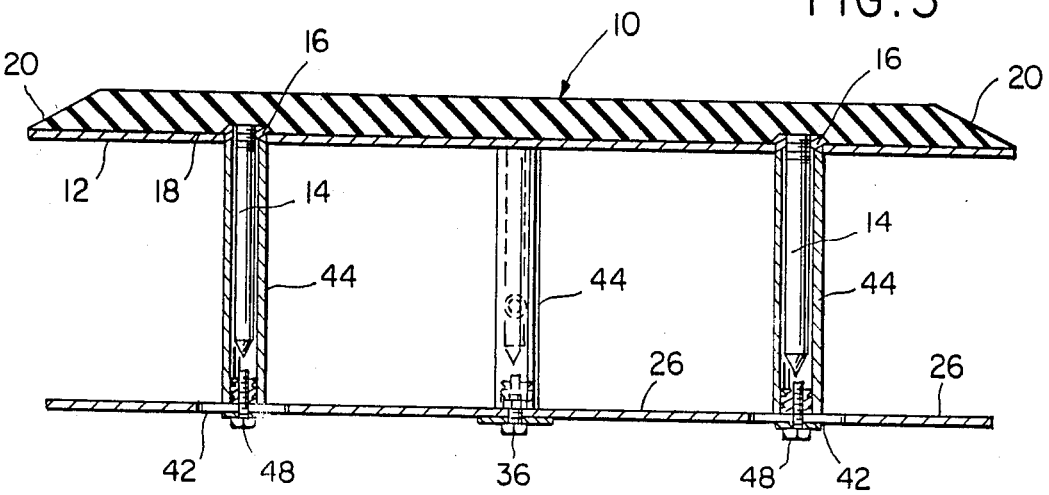

GROUND ANCHOR FOR HOME PLATE AND PITCHER'S PLATE AND METHOD OF INSTALLATION

BACKGROUND OF THE INVENTION

1. Field of the Invention

This invention relates to the combination of an adjustable, substantially permenantly below ground surface installed ground anchor and a ground level ball game attachment such as a home plate or pitcher's plate engageable with the ground anchor without utilization of accessory-type attaching means.

The ground anchor portion of the combination is adjustable to compensate for different horizontal spacing between ground spikes provided on the associated ground surface attachment and the adjustable components of the ground anchor include upstanding tubular members or sleeves downwardly into which the depending ground spikes on a home plate or pitcher's plate may be removably telescopingly received The sleeves may be adjusted relative to each other in horizontal spacing and the upper ends of the sleeves are disposed in a horizontal plane coinciding with the surface of the ground and may be removably capped upon removal of the associated home plate or pitcher's plate. The upper ends of the capped sleeves are disposed at or slightly above ground level and this enables the home plate and pitcher's mound areas to be dragged in a manner ensuring proper elevation of the pitcher's mound plate relative to home plate after a dragging operation has been carried out and the pitcher's mound plate and home plate are reinstalled.

2. Description of Related Art

Various different forms of below ground level anchors for baseball bases and other similar structures heretofore have been provided. Examples of these previously known devices are disclosed in U.S. Pat. Nos. 1,244,044; 2,405,492; 3,204,958; 3,572,705; 3,862,756; 3,971,558; 4,162,789 and 4,266,768. However, these previously known forms of below ground surface anchors do not include the combined structural and operational features of the instant invention.

SUMMARY OF THE INVENTION

On a baseball field, the home plate and pitcher's plate are conventionally provided with five and three, respectively, downwardly projecting ground spikes which are substantially rigid with the corresponding plates and when the home plate area and pitcher's mound of a baseball diamond are dragged or raked, it is necessary to remove home plate and the pitcher's plate from engagement with the ground. After the home plate area and pitcher's mound have been dragged and/or raked and recontoured, home plate and the pitcher's plate must be reengaged with the ground in the proper location. In addition, the elevation of the pitcher's mound relative to home plate must be maintained. Accordingly, the grounds keeper's job in recontouring the pitcher's mound to the proper level, dragging or raking the home plate area and reinstalling the pitcher's plate as well as home plate requires a considerable amount of skill. However, such considerable skill is not always readily available and particularly at school and public recreational baseball fields. Accordingly, a need exists whereby home plate and the pitcher's plate may be readily reinstalled in precisely the same location and the precise elevation of the pitcher's plate relative to home plate may be obtained after grounds keeping operations on the home plate and pitcher's mound areas of a baseball field have been carried out.

The main object of this invention is to provide a ground anchor for a baseball diamond home plate and pitcher's plate with which a conventional ground spike equipped home plate and a ground spike equipped pitcher's plate may be readily engaged after a grounds keeping operation has been carried out.

Yet another object of this invention is to provide a ground anchor for home plate and the pitcher's plate of a baseball diamond including structure which will render home plate and the pitcher's plate readily removable while still rigidly anchoring home plate and the pitcher's plate against movement relative to the ground.

Still another object of this invention is to provide a ground anchor in accordance with the preceding objects and including structure by which the ground anchor may be adjusted according to horizontal spacing between ground spike equipped home and pitcher's plates marketed by different manufacturers.

Another important object of this invention is to provide ground anchors for a home plate and a pitcher's plate and constructed in a manner such that the ground anchors will indicate the proper ground upper surface level at both the home plate area and the pitcher's mound area during home plate and pitcher's mound grooming operations.

A final object of this invention to be specifically enumerated herein is to provide ground anchors in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a top prospective view of a typical ground spike equipped home plate with a ground anchor constructed in accordance with the present invention operatively associated therewith;

FIG. 2 is an enlarged vertical sectional view taken substantially upon the plane indicated by the section line 2—2 of FIG. 1;

FIG. 3 is a vertical sectional view taken substantially upon the plane indicated by the section line 3—3 of FIG. 2;

DESCRIPTION OF THE PREFERRED EMBODIMENT

Figure 4:
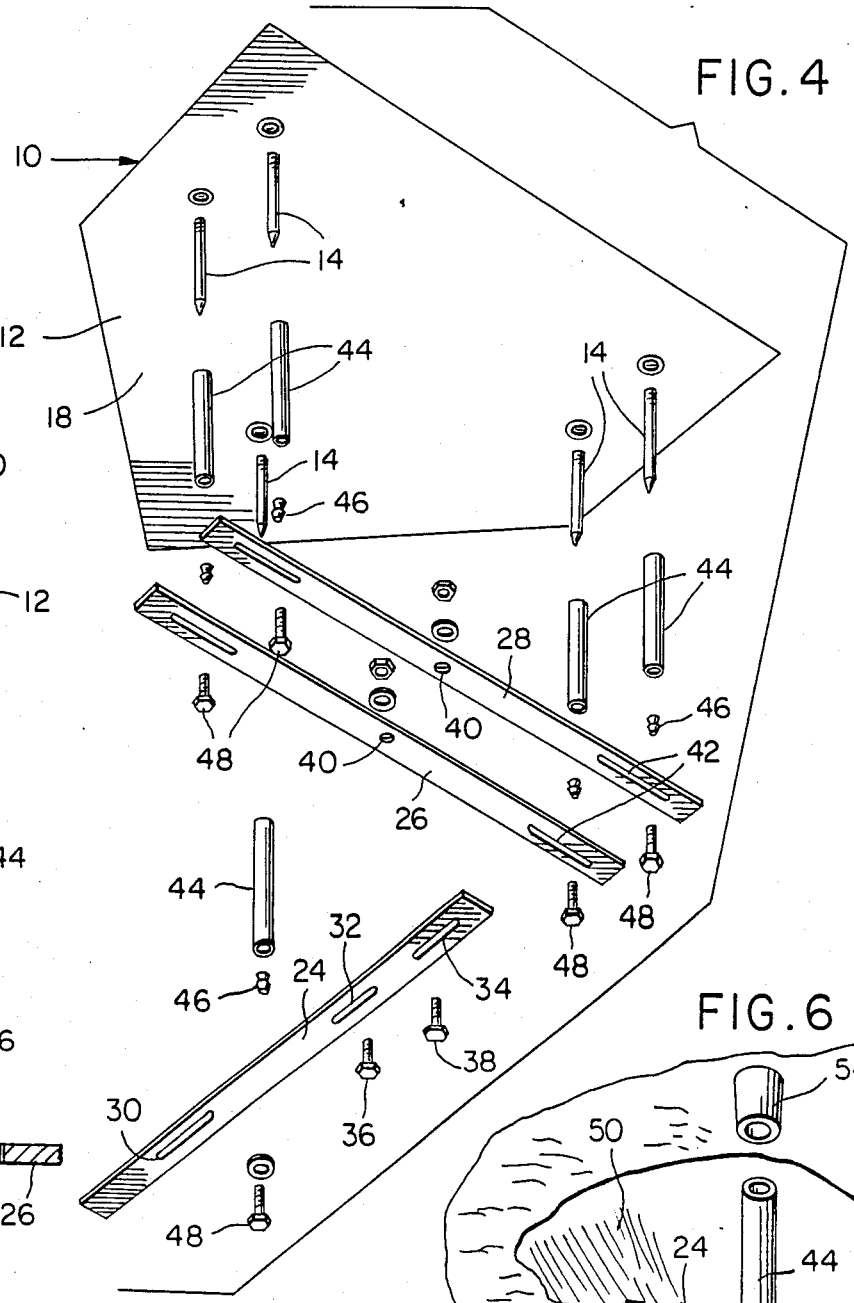
FIG. 4 is a bottom exploded perspective view of the assembledge illustrated in FIG. 1.

Referring now more specifically to the drawings and to FIGS. 1 and 4 in particular, the numeral 10 generally designates a typical home plate comprising a planar body 12 equipped with five depending ground spikes 14 whose upper ends are removably threaded in downwardly opening threaded sockets 16 mounted substantially flush with the undersurface 18 of the body 12. In addition, the marginal edges of the body 12 may be beveled as at 20, see FIGS. 1–3.

The foregoing comprises a description of a conventional home plate.

A first form of ground anchor constructed in accordance with the present invention is referred to in general by the reference numeral 22. The ground anchor 22 includes a horizontally elongated plane-like structure incorporating a single central elongated strap member 24 and a pair of elongated transverse strap members 26 and 28 spaced along the strap member 24 and extending transversely thereof above the latter. The strap member 24 includes three longitudinal slots 30, 32, and 34 spaced longitudinally therealong and shank-type fasteners 36 and 38 are secured through the slots 32 and 34 and central bores 40 formed in the longitudinal central portions of the strap members 26 and 28. The opposite ends of the strap members 26 and 28 are provided with longitudinal slots 42 and the lower ends of upstanding anchor sleeves 44 have expandable anchor plugs 46 disposed therein and by which the lower ends of the sleeves 44 are anchored to the slotted opposite ends of the strap members 26 and 28 and the slotted end of the strap member 24 by washer equipped threaded fasteners 48 secured through the slots 42 and 30 and threadedly engaged in the anchor plugs 46. Because of the slots 30 and 42, the horizontal spacing between the anchor sleeves 44 may be adjusted according to the horizontal spacing between the ground spikes 14.

In actual practice, when adjusting the positioning of the anchor sleeves 44, the ground anchor 22 is inverted over the inverted home plate 10 and the sleeves 44 are downwardly telescoped over the ground spikes 14 before the fasteners 36, 38 and 48 are tightened.

After the ground anchor 22 has been thus assembled with the sleeves 44 in the proper horizontally spaced apart positions, a hole 50 is dug in the ground 52 and the ground anchor 22 is installed and properly leveled within the hole 50 in position therein with the upper terminal ends of the sleeves 44 disposed in a horizontal plane flush with the upper surface of the ground 52. Then, the hole may be filled about the anchor 22 after closure caps 54 are disposed over and removably close the upper ends of the sleeves 44 to prevent the entrance of dirt thereinto.

After the hole 50 has been properly filled and the dirt replaced therein has been properly tamped and leveled, the closure caps 54 may be removed and the home plate 10 may be disposed over the upper ends of the sleeves 44 for downward reception of the ground spikes 14 into the sleeves 44. When installing the home plate 10, the upper ends of the sleeves 44 are downwardly abutted by the threaded sockets or anchors 16 in a manner such that the undersurface of the home plate 10 is resting upon the upper surface of the ground 52.

The closure caps may be replaced by threaded plugs (if the upper ends of the sleeves 44 are internally threaded), or the closure caps 54 could be internally threaded and threadedly engaged with externally threaded upper end portions of the sleeves 44.

Inasmuch as the closure caps (or alternate plugs) project slightly above the upper ends of the sleeves 44, home plate 10 may be removed from the home plate area of a ball diamond and the home plate area may be groomed by dragging or raking with the upper ends of the closure caps 54 indicating the correct elevation of the groomed home plate area.

Figure 7:
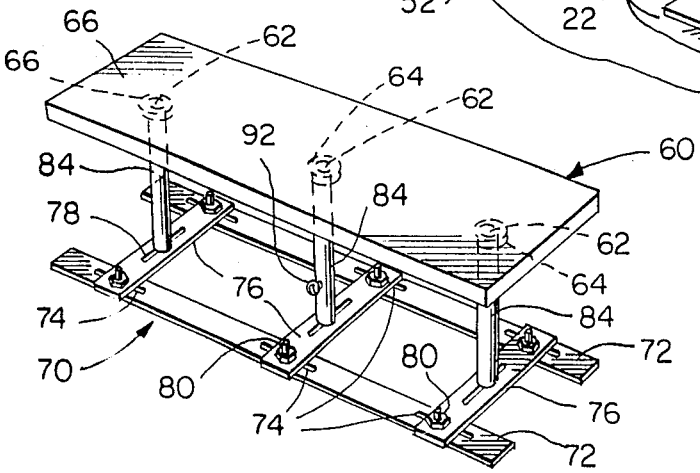
FIG. 7 is a top perspective view of a second form of ground anchor having a ground spike equipped pitcher's plate operatively associated therewith.

With attention now invited more specifically to FIG. 7, the numeral 60 generally designates a pitcher's plate incorporating three depending ground spikes 62 corresponding to the spikes 14 and threadingly supported from threaded sockets 64 supported from the body 66 of the pitcher's plate 60 and opening downwardly therefrom. In addition, the numeral 70 generally designates a ground anchor constructed in accordance with the present invention for usage in conjunction with the pitcher's plate 60.

The ground anchor 70 includes a pair of parallel longitudinally extending strap members 72 which are longitudinally slotted as at 74 and three transverse strap members 76 which are centrally longitudinally slotted as at 78 and include apertured opposite end portions registrable with the slot 74. Suitable shank-type fasteners 80 are secured through the slots 74 and corresponding apertured end portions of the straps 76 and the lower ends of anchor plug equipped sleeves 84 are supported from the strap members 76 through the utilization of fasteners corresponding to the fasteners 48 and secured upwardly through the slots 78 and in the plugs carried by the lower ends of the sleeves 84.

Thus, the ground anchor 70 and pitcher's plate 60 form an assembledge corresponding to the assembly represented by the combination of the home plate 10 and ground anchor 22. Of course, the ground anchor 70 is adjusted relative to the horizontal spacing between the ground spikes 62 before the ground anchor 70 is embedded in the ground in the manner previously described in conjunction with the ground anchor 22 and with the upper ends of the sleeves 84 disposed in a horizontal plane substantially flush with the surface of the ground. Of course, closure caps corresponding to the closure caps 54 (or externally threaded closure caps or internally threaded closure plugs) are provided for the sleeves 84. Thus, the corresponding pitcher's mound area may be dragged and/or raked during a field grooming operation in a manner such that the surface of the ground coincides with the upper ends of the sleeves 84. In this manner, proper elevation of the pitcher's plate 60 relative to the home plate 10 will be maintained.

Figure 5:
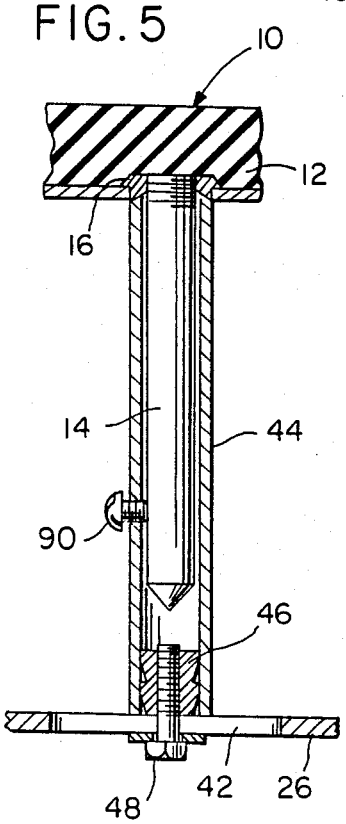
FIG. 5 is a fragmentary enlarged vertical sectional view of the lower left hand portion of FIG. 3.
Figure 6:
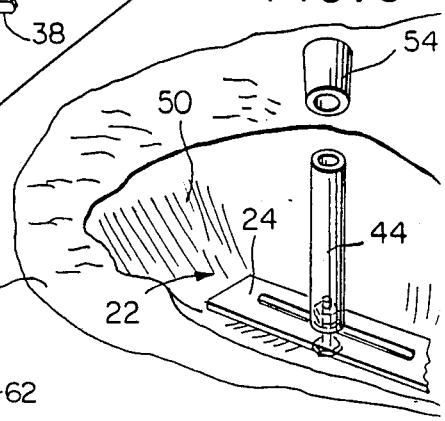
FIG. 6 is a fragmentary perspective view of the ground anchor partially installed in the ground and with a removable closure cover in exploded position relative to the upper end of one of the sleeves of the ground anchor.

If for any reason it becomes necessary to positively anchor home plate 10 or pitcher's plate 60 relative to the corresponding ground anchors 22 and 70, as may be seen from FIGS. 1, 2 and 5 of the drawings, one of the sleeves 44 is provided with a set screw 90 which may be tightened into tight clamped engagement with the corresponding ground spike 14 immediately prior to the hole 50 being filled. In addition, a corresponding set screw 92 may be provided on the ground anchor 70, see FIG. 7. In this manner, home plate 10 and the pitcher's plate 60 may be secured against unauthorized removal, the set screws 90 and 92 being located relative to the plates 10 and 60 such that a small hole may be dug in the appropriate location to provide access to either the set screw 90 or the set screw 92.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An assembly including a below ground surface anchor and a ground surface attachment anchored relative to said anchor, said anchor including a horizontally elongated substantially planar anchor structure in the form of a horizontal skeletal frame of first and second relatively angulated and rigidly interconnected elongated horizontal members, a plurality of upstanding tubular members including lower ends anchored to horizontally spaced apart portions of said skeletal frame and projecting substantially vertically upwardly therefrom, said tubular members including open upper ends terminating in a horizontal plane and spaced a predetermined distance above said frame, said attachment including a conventional baseball or softball pitcher's mount or home plate having a horizontal undersurface and depending anchor members attached thereto, said anchor members being removably and telescopingly received within said tubular members to a depth with said undersurface at least substantially abutting said upper ends.

2. The assembly of claim 1 including a plurality of closure members removably engageable with said upper ends of said tubular members.

3. The assembly of claim 2 wherein said closure members include downwardly opening cap members downwardly engageable over the upper ends of said tubular members.

4. The assembly of claim 1 wherein said frame and at least one of said tubular members include coacting means securing the lower end of said tubular member to said frame for horizontal rectilinear adjustment of said tubular member relative to said frame along a predetermined horizontal path.

5. The assembly of claim 4 wherein said coacting means also includes means securing the lower end of at least one other tubular member to said frame for horizontal rectilinear adjustment relative to said frame along a second predetermined path disposed transverse to the first mentioned path.

6. An assembly including a below ground surface anchor and a ground surface attachment anchored relative to said anchor, said anchor including a horizontally elongated substantially planar anchor structure, a plurality of upstanding tubular members including lower ends anchored to horizontally spaced apart portions of said anchor structure and projecting substantially vertically upwardly therefrom, said tubular members including open upper ends terminating upwardly in a horizontal plane spaced a predetermined distance above and generally paralleling said substantially planar anchor structure, said attachment including conventional baseball or softball pitcher's mound or home plate having a horizontal undersurface and depending anchor members attached thereto, said anchor members being removably and telescopingly received within said tubular members to a depth with said undersurface at least substantially abutting said upper ends, said substantially planar anchor structure and at least one of said tubular members including coacting means securing the lower end of said at least one tubular member to said substantially planar anchor structure for horizontal rectalinear adjustment of said at least one tubular member relative to said substantially planar anchor structure along a predetermined path.

* * * * *